United States Patent [19]

Miller

[11] 4,453,490

[45] Jun. 12, 1984

[54] OAR REST FOR ROW BOATS

[76] Inventor: James A. Miller, 204 E. Diamond St., Kendallville, Ind. 46755

[21] Appl. No.: 326,607

[22] Filed: Dec. 2, 1981

[51] Int. Cl.[3] ..... B63B 17/00

[52] U.S. Cl. ..... 114/364; 440/104

[58] Field of Search ..... 114/343, 364; 440/101-110; 224/273, 277, 278, 42.42, 42.45 R; 248/200, 534, 538, 539

[56] References Cited

U.S. PATENT DOCUMENTS

| | | | |
|---|---|---|---|
| 1,491,851 | 4/1924 | Ferris | 440/109 |
| 2,598,130 | 5/1952 | Mallison | 114/364 |
| 2,724,131 | 11/1955 | Stuart | 114/364 |
| 2,734,205 | 2/1956 | Preiss | 114/364 |
| 2,734,206 | 2/1956 | John | 114/364 |
| 2,885,696 | 5/1959 | Saver | 114/364 |
| 3,281,875 | 11/1966 | Solomon | 440/107 |
| 3,500,483 | 3/1970 | Schohn | 114/364 |

FOREIGN PATENT DOCUMENTS

| | | | |
|---|---|---|---|
| 1212125 | 11/1970 | United Kingdom | 440/106 |

*Primary Examiner*—Trygve M. Blix
*Assistant Examiner*—Stephen P. Avila
*Attorney, Agent, or Firm*—George A. Gust

[57] ABSTRACT

An oar rest for row boats includes a generally U-shaped clamp having spaced apart mounting arms which are joined at one end by an elongated bar section. One of the arms adjacent its distal end has a clamping jaw portion which faces the other arm. A clamping screw is threaded into the other arm and carries on its inner end a clamping pad operatively juxtaposed with respect to the jaw portion. A pair of spaced retaining fingers are fixedly secured to the bar section and extend in a direction away from the clamping arms. These retaining fingers are spaced in a direction parallel to the direction of spacing between the clamping arms, the spacing between the fingers being less than that between the arms but sufficient to receive therebetween the blade of an oar.

4 Claims, 5 Drawing Figures

OAR REST FOR ROW BOATS

BACKGROUND OF THE INVENTION

1. Field of the Invention

The present invention relates to stationary supports for boat oars, and more particularly to a clamping device which may be removably secured to the side of a row boat for retaining the blade of an oar in rested position.

2. Description of the Prior Art

Oar locks and clamping devices for removably securing oar locks to the sides or transom of a boat are well known as disclosed in U.S. Pat. Nos. 1,185,178; 1,335,606; 1,491,851; 2,795,804; 3,108,565; 3,191,203; 3,281,875 and 3,534,702. Such oar locks are conventionally swiveled on their respective supports so that the oars may be manipulated in a swinging motion for rowing the boat. Thus, such oar locks are usually free to swivel about an upright axis and can assume any swivel position depending upon the swinging of the oars.

SUMMARY OF THE INVENTION

This invention employs an oar rest which may be removably attached to the side of a boat and which is used in conjunction with a conventional oar lock for resting the blade of an oar in longitudinal alignment with the side of a boat. The oar rest includes a generally U-shaped clamp having spaced apart mounting arms which are joined by an elongated bar section. One of the arms has adjacent to its distal end a clamping jaw portion facing the other arm. A clamping screw is threaded into the other arm and carries on its inner end a clamping pad juxtaposed with respect to the jaw portion on the one arm. A pair of spaced retaining fingers are fixedly secured to the bar section and extend in a direction oppositely from the two clamping arms, these retaining fingers further being spaced in a direction parallel to the spacing between the clamping arms. The spacing between the fingers is less than that between the arms thereby to receive the blade of an oar therebetween. With the midportion of the oar resting in an oar lock, the oar rest clamped to the side of a boat near the transom, the blade of an oar may be nested between the retaining fingers thereby to rest the oar in such position that it parallels the side of the boat immediately thereabove.

It is an object of this invention to provide an oar rest for row boats.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
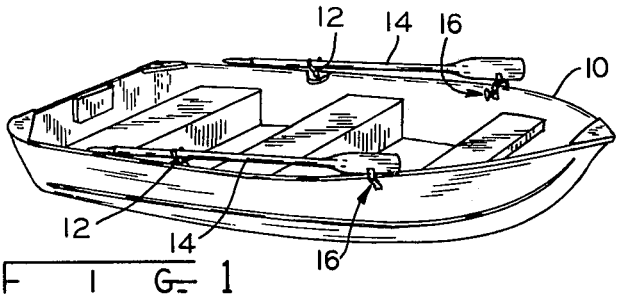
FIG. 1 is a perspective view of a conventional row boat showing oars being rested on oar rests of this invention.
Figure 2:
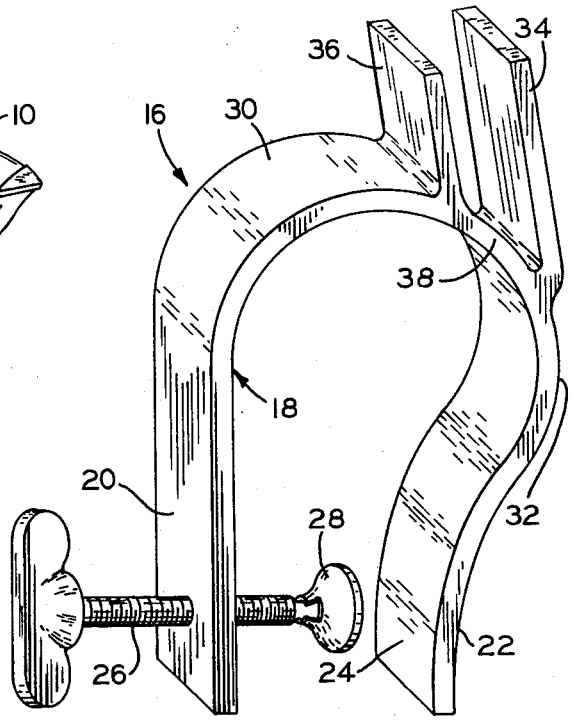
FIG. 2 is a perspective illustration of one oar rest embodiment of this invention.
Figure 5:
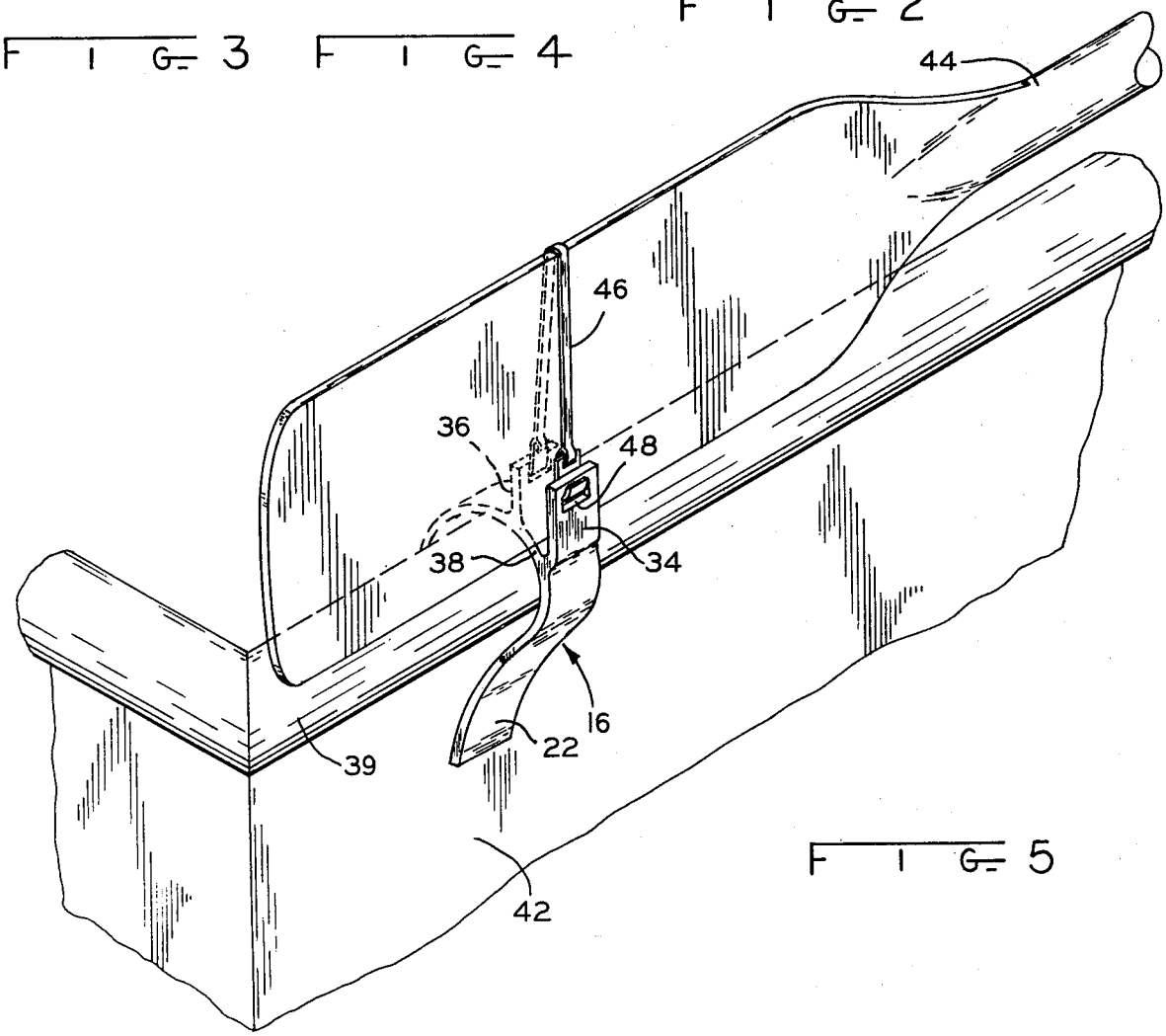
FIG. 5 is a fragmentary perspective view showing an oar rest of this invention mounted on the side of a boat near the transom thereof and with the blade of an oar nested therein.

Referring to the drawings, FIG. 1 illustrates a typical row boat 10 having conventional, swivelable oar locks 12 thereon which mount a pair of oars 14 for swinging movement. Toward the bow of a boat and on the gunwales are two oar rests 16 removably clamped thereto and which are adapted to support and retain the blades of the two oars 14. Such oar rests 16 may also be removably clamped onto the boat sides or gunwales toward the transom end as shown in FIG. 5.

Each oar rest 16 includes a generally U-shaped clamp 18 having juxtaposed, spaced apart and generally parallel clamping arms 20 and 22, the arm 22 adjacent its distal end having a jaw portion 24. The arm 20 threadedly receives therethrough a clamping screw 26 which carries on its inner end a clamping pad 28 disposed opposite the jaw portion 24 on the arm 22.

The two arms 20 and 22 are joined at the upper ends thereof by means of an elongated bar section 30 which is smoothly outwardly curved as shown to merge with a curvilinear portion 32 which constitutes the upper portion of the arm 22. The clamp member 18 is preferably formed of a flat aluminum bar which is about three-sixteenths inch (3/16") in thickness and one inch (1") wide.

Integrally formed with and upstanding from the bar section 30 are two parallel, spaced apart oar-retaining fingers 34 and 36, the finger 34 being located substantially in line with the outermost portion of the curved portion 32 of the arm 22, and the finger 36 being disposed slightly outboard of the midportion of the bar section 30 and otherwise somewhat in vertical alignment with the jaw portion 24 of the arm 22. The portion 38 of the bar section 30, between the two fingers 34 and 36 is curved downwardy toward the arm 22 so as to form an acute angle between the finger 34 and the bar portion 38. Further, as shown more clearly in FIGS. 3 and 4, the fingers 34 and 36 are angled rearwardly toward the arm 20. Thus, with the side of the boat being angled slightly outwardly, and the oar rest in place, the fingers 34 and 36 will be disposed substantially upright.

In use, the oar rest 16 is clamped to the gunwale or side of the boat. This is accomplished by turning the screw 26 so as to make the space between the jaw surface 24 and clamping pad 28 suitably large. The oar rest is then passed over the upper edge of the boat side which, on a conventional jon boat is cylindrical as indicated by the numeral 34 (FIG. 3) and in other conventional boats is in the form of a flat strip 40 (FIG. 4). The clamping screw 26 is then turned inwardly until the boat side 42 is clamped between the jaw surface 24 and pad 28. The curvature of the clamp 18 tends to conform to that of the cylindrical edge 39 but is made large enough so as to provide for suitable clearance and fit with respect to the strip type edge 40.

Figure 3:
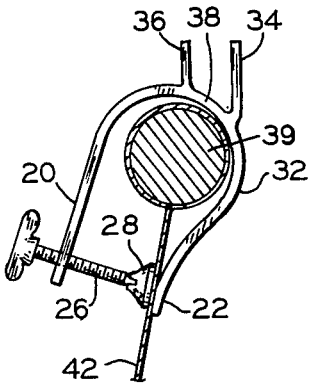
FIG. 3 is a fragmentary sectional view of the side of a boat having one of the oar rests of this invention mounted thereon.
Figure 4:
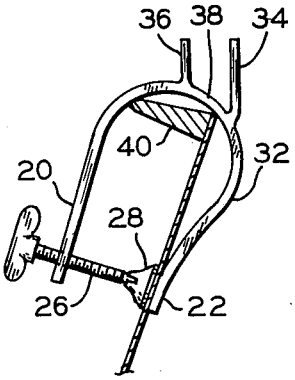
FIG. 4 is a view similar to that of FIG. 3 but showing a different configuration of the gunwale portion of the boat.

Row boats normally have the sides 42 flared outwardly as shown more clearly in FIGS. 3 and 4. When the oar rest 16 is properly secured in place, the fingers 34 and 36 extend substantially upright and are disposed toward the outboard portion of the boat side 42.

As shown in FIG. 1, the oar rests 16 are located toward the bow of the boat and in FIG. 5 toward the transom. In either position, the blade of an oar 44 can be inserted between the fingers 34 and 36 where it will normally rest at the apex formed between the finger 34 and the bottom portion 38. In this position, the blade will be disposed toward the outside of the boat such that any water or debris will drain outside of the boat rather than inside.

For transporting purposes, if it is desired to leave the oars in position in the oar locks, a band or strand 46 of some suitable material may be secured at its opposite ends to suitable apertures in the upper ends of the fingers 34 and 36, respectively, and passed over the oar blade and there tightened to hold the latter downwardly against the bar section 38 and the finger 34. The strand 46 may, of course, be of a suitable elastic material or alternatively may include a conventional belt buckle.

While there have been described above the principles of this invention in connection with specific apparatus, it is to be clearly understood that this description is made only by way of example and not as a limitation to the scope of the invention.

What is claimed is:

1. An oar rest for row boats comprising a generally U-shaped clamp having spaced apart mounting arms joined by an elongated bar section, one of said arms adjacent the distal end having a clamping jaw portion facing the other arm, a clamping screw threaded into the other arm and carrying on its inner end a clamping pad juxtaposed with respect to said jaw portion, a pair of spaced retaining fingers fixedly secured to said bar section and extending oppositely from said clamping arms and above and beyond said bar section, said retaining fingers being spaced in a direction parallel to the spacing between said clamping arms, the spacing between said fingers being less than that between said arms but great enough to receive therebetween the blade of an oar, said bar section being upwardly curved and the upper portion of said one arm being outwardly curved as a smoothly curved extension of said bar section, one of said fingers being disposed immediately adjacent to the outermost portion of said upper arm portion but just inwardly thereof and forming an acute angle with said bar section, said bar section extending angularly upwardly away from said one finger but toward said other finger thereby to dispose the blade of an oar in said fingers above said bar section and within said acute angle toward the outboard side of a boat on which the clamp is mounted whereby a wet oar blade will tend to drain outboard and said outermost portion of said upper arm portion tends to provide protection against accidental engagement by other objects, said one finger being the outermost of said two fingers said jaw portion extending generally parallel to said other arm.

2. The oar rest of claim 1 wherein said clamp and fingers are integral, said fingers are parallel, and said other clamping arm is straight.

3. The oar rest of claim 2 wherein the bar section between said fingers curves downwardly from said other finger toward said one finger to thereby form said acute angle between said one finger and said bar section.

4. The oar rest of claim 1 including a boat side having a swivelable oar lock thereon, an oar mounted on said oar lock, said oar rest being clamped on said boat side spaced from said oar lock in such position as to receive the blade of said oar between said fingers.

* * * * *